US011606996B1

(12) United States Patent
Clark

(10) Patent No.: US 11,606,996 B1
(45) Date of Patent: Mar. 21, 2023

(54) MAGNETIC HAIR EXTENSION ACCESSORY

(71) Applicant: Sarah Clark, Chepachet, RI (US)

(72) Inventor: Sarah Clark, Chepachet, RI (US)

( * ) Notice: Subject to any disclaimer, the term of this patent is extended or adjusted under 35 U.S.C. 154(b) by 124 days.

(21) Appl. No.: 17/181,779

(22) Filed: Feb. 22, 2021

Related U.S. Application Data

(60) Provisional application No. 62/980,123, filed on Feb. 21, 2020.

(51) Int. Cl.
*A45D 8/00* (2006.01)
*A41G 5/00* (2006.01)

(52) U.S. Cl.
CPC ..... *A41G 5/0073* (2013.01)

(58) Field of Classification Search
CPC . A45D 8/004; A45D 8/20; A45D 8/24; A45D 8/28; A41G 5/00; A41G 5/004; A41G 5/0053; A41G 5/0073
See application file for complete search history.

(56) References Cited

U.S. PATENT DOCUMENTS

| | | | | |
|---|---|---|---|---|
| 4,934,387 | A | 6/1990 | Megna | |
| 5,741,336 | A | 4/1998 | Fraser | |
| 5,857,468 | A | 1/1999 | Camp, Jr. et al. | |
| 2008/0060667 | A1* | 3/2008 | Bandonis | A45D 24/36 132/214 |
| 2008/0257369 | A1 | 10/2008 | Poole | |
| 2009/0056730 | A1 | 3/2009 | Wilson et al. | |
| 2013/0298925 | A1* | 11/2013 | Gold | A41G 5/008 132/53 |
| 2019/0090567 | A1 | 3/2019 | Johnson | |
| 2019/0216152 | A1* | 7/2019 | Francis | A41G 5/0073 |
| 2019/0254372 | A1* | 8/2019 | Rigby | A41G 5/0053 |
| 2019/0373973 | A1 | 12/2019 | Richwine | |

FOREIGN PATENT DOCUMENTS

| | | | |
|---|---|---|---|
| JP | 4761521 | A | 4/2006 |
| JP | 5075289 | B1 | 8/2012 |
| KR | 100645968 | B1 | 11/2006 |
| KR | 101118369 | B1 | 2/2012 |
| KR | 101156773 | B1 | 6/2012 |

* cited by examiner

*Primary Examiner* — Rachel R Steitz
(74) *Attorney, Agent, or Firm* — Quickpatents, LLC; Kevin Prince

(57) ABSTRACT

A hair accessory for attaching hair extensions to a person's hair includes a clip having front and back members pivotally connected with a hinge. Each member has inner and outer sides. One or more magnets are fixed with the front and back members of the clip, aligned with one another to maintain the clip in a closed position magnetically. The hair extensions are fixed with the outer side of the members. In use with the clip moved from an open position to the closed position about the person's hair, the hair extensions hang downwardly to augment the appearance of the person. The person's hair not within the clip can be combed over the clip to hide the clip from casual view.

18 Claims, 8 Drawing Sheets

MAGNETIC HAIR EXTENSION ACCESSORY

CROSS-REFERENCE TO RELATED APPLICATIONS

This application claims the benefit of U.S. Provisional Patent Application 62/980,123, filed on Feb. 21, 2020, and is incorporated herein by reference.

STATEMENT REGARDING FEDERALLY SPONSORED RESEARCH AND DEVELOPMENT

Not Applicable.

FIELD OF THE INVENTION

This invention relates to hair care, and more particularly to a hair extension accessory.

BACKGROUND

Currently on the market there are several different devices used to attach hair extensions to a person's natural hair and to achieve a longer hair appearance. Some devices and methods include braiding, bonding, heat fusion, clip in, sew in, and tape in. These methods are very difficult for people to achieve by themselves and should be applied by a certified professional so they are done correctly. These methods are also time consuming, expensive and can damage the hair beyond repair.

Therefore, there is a need for a device that provides an easy-to-use clip-on arrangement for adding hair extensions to a person's natural hair. Such a needed device would use magnets to secure the clip together around the person's natural hair, and would be relatively discrete and easily coverable by the person's natural hair. Further, such a needed device would be relatively simple to manufacture, store and use. The present invention accomplishes these objectives.

SUMMARY OF THE INVENTION

The present device is a hair accessory for attaching hair extensions to the hair of a person. A clip has a front member and a back member. Each member has a proximal end mutually pivotally connected with a hinge. Each member has an inner side and an outer side, the clip being positionable between an open position wherein each member is mutually separated and a closed position wherein the inner sides of the members are substantially in mutual contact and alignment. Preferably the hinge is a living hinge, such that the front member, living hinge, and back member are all integrally formed from a non-rigid material, such as an elastomeric material such as silicone rubber, or the like.

One or more magnets are fixed with the front member of the clip. The back member of the clip includes one or more corresponding magnetically-attractive elements, each of which are aligned with one of the magnets on the front member when the clip is in the closed position. Preferably each of the magnetically-attractive elements is another of the magnets oriented with an opposing polarity to the magnets with which they are aligned on the front member when the clip is in the closed position.

In some embodiments of the invention, each magnet is fixed to the front member in a well that projects away from the inner side of the front member. Similarly each magnetically-attractive element is fixed in another of the wells that projects away from the inner side of the back member. Each protruding well makes substantial mutual contact when the clip is in the closed position. The magnets each attract the magnetically-attractive elements through the front and back members, and a space is defined between the inner sides of the front and back members for capturing the person's hair therebetween.

The hair extensions are fixed with at least the outer side of the front member, and preferably also with the outer side of the back member and the hinge. Preferably the hair extensions are fixed with the clip at the outer sides of the members with adhesive tape, preferably being a medical grade adhesive tape and, in some embodiments, transparent tape.

In use with the clip closed about the person's hair, the hair extensions hang downwardly to augment the appearance of the person. The person's hair not within the clip can be combed over the clip to hide the clip from casual view.

The present invention is a device that provides an easy-to-use clip-on arrangement for adding hair extensions to a person's natural hair. The present device uses magnets to secure the clip together around the person's natural hair, and is relatively discrete and easily coverable by the person's natural hair. Further, the present invention is relatively simple to manufacture, store and use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
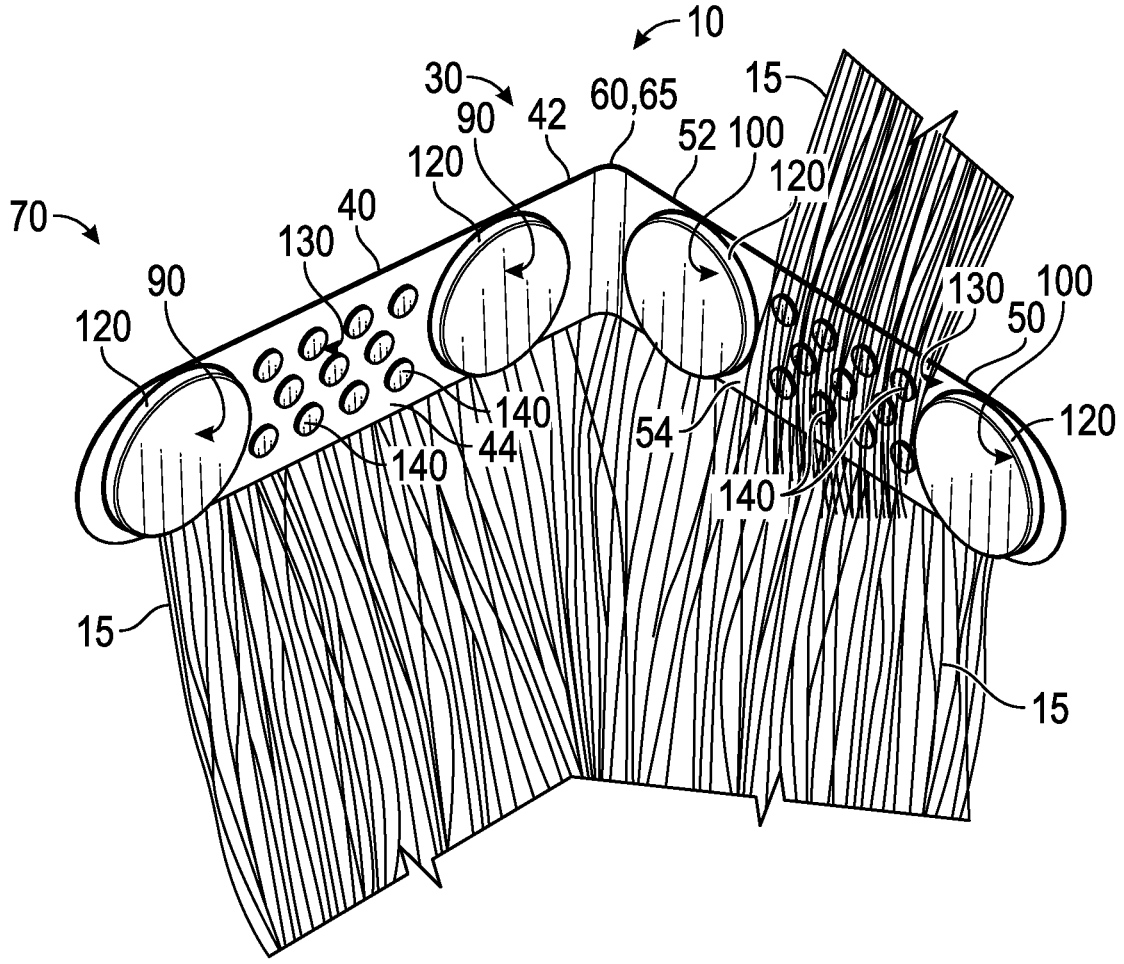
FIG. 1 is a perspective view of a clip of the present invention, illustrated in an open position.
Figure 2:
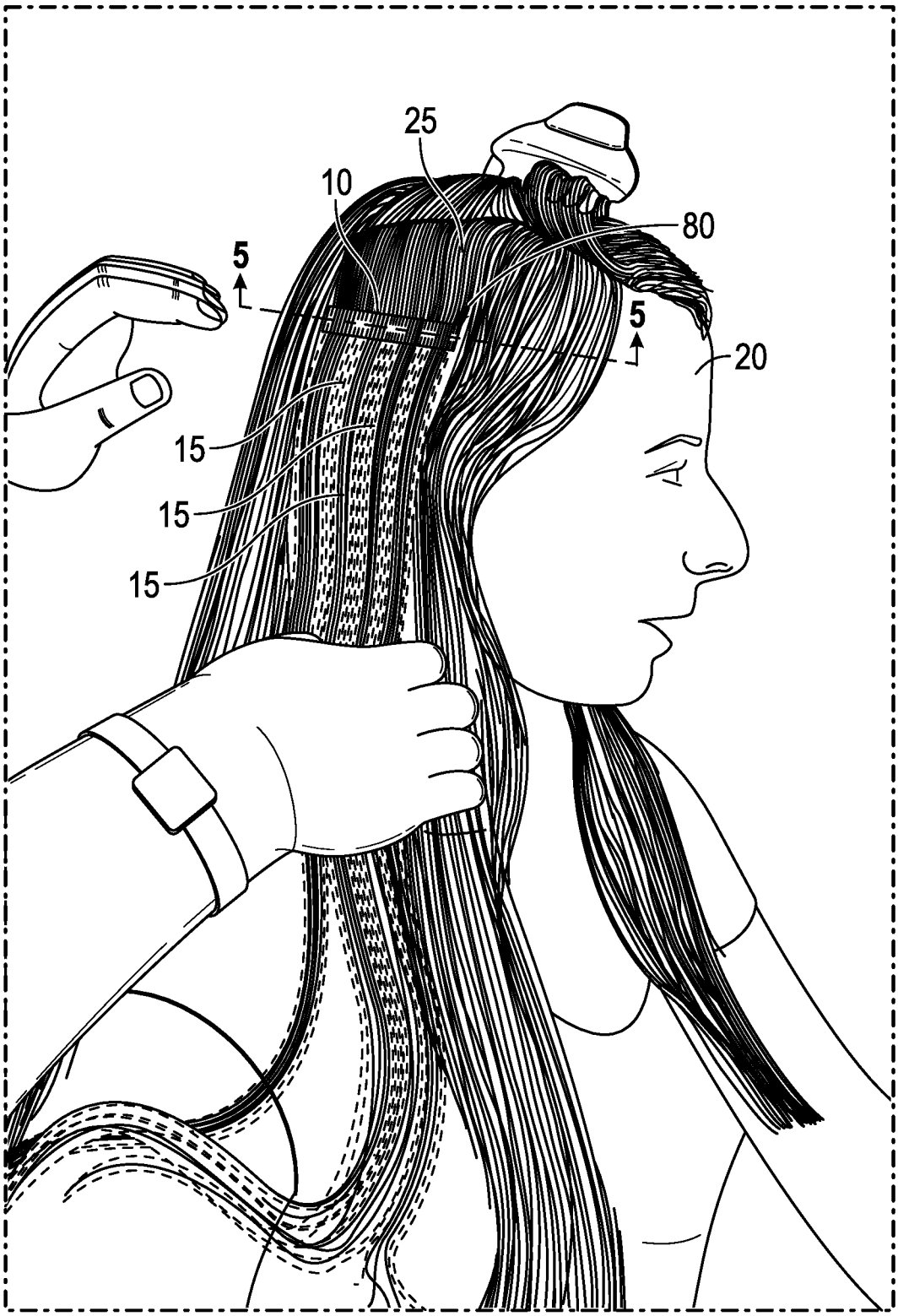
FIG. 2 is a side elevational view of the clip in-use with a person, illustrated in a closed position.
Figure 3:
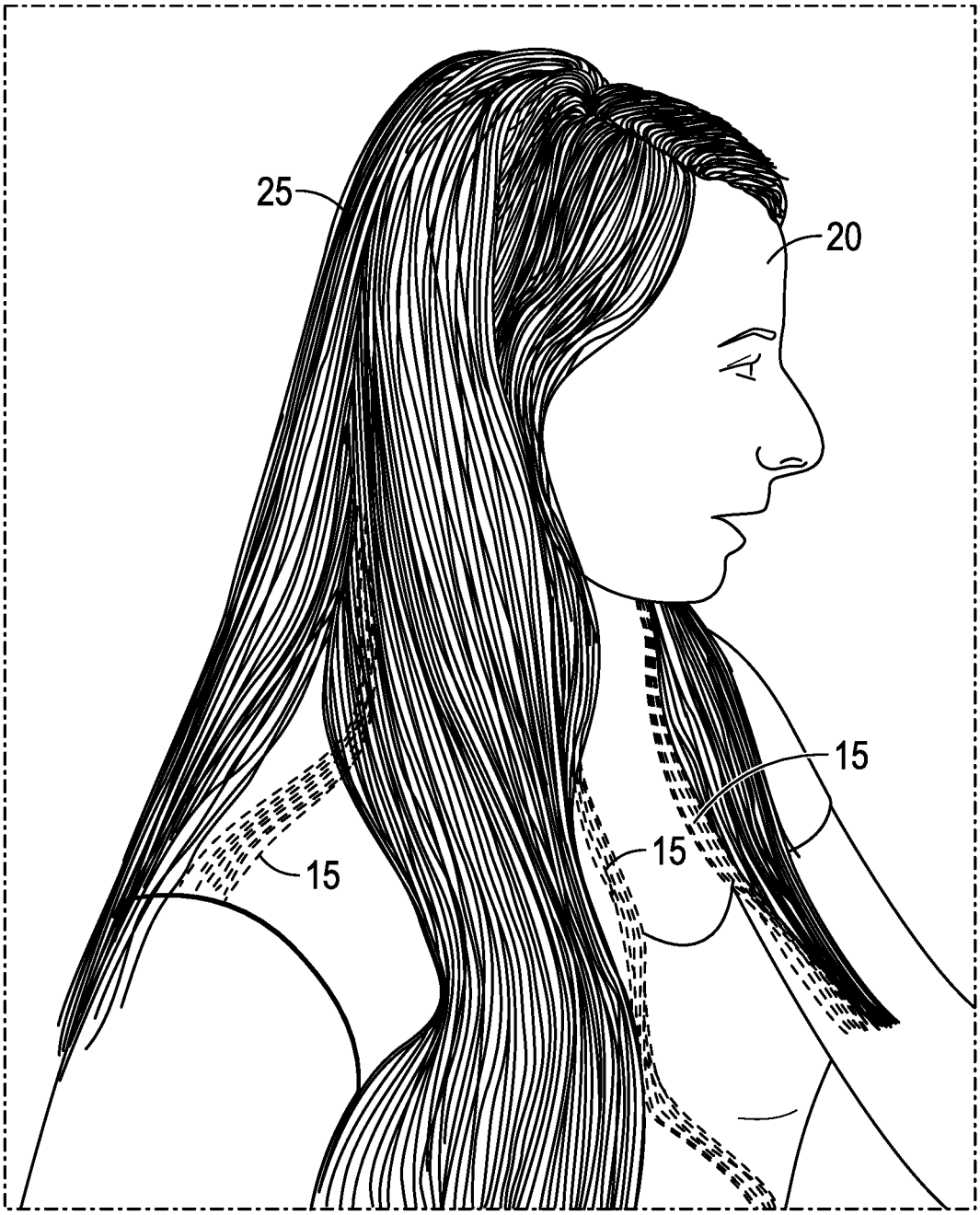
FIG. 3 is a side elevational view of the clip in-use with the person's hair combed around the clip to shield the clip from casual view.

FIGS. 1-3 illustrate a hair accessory 10 for attaching hair extensions 15 to the hair 25 of a person 20. A clip 30 has a front member 40 and a back member 50. Each member 40,50 has a proximal end 42,52 mutually pivotally connected with a hinge 60. Each member 40,50 has an inner side 44,54 and an outer side 46,56, the clip 30 being positionable between an open position 70 wherein each member 40,50 is mutually separated (FIGS. 1 and 4), and a closed position 80 (FIGS. 2-3, and 5) wherein the inner sides 44,54 of the members 40,50 are substantially in mutual contact and alignment.

Preferably the hinge 60 is a living hinge 65, such that the front member 40, living hinge 65, and back member 50 are all integrally formed from a non-rigid material, such as an elastomeric material such as silicone rubber, or the like.

Figure 5:
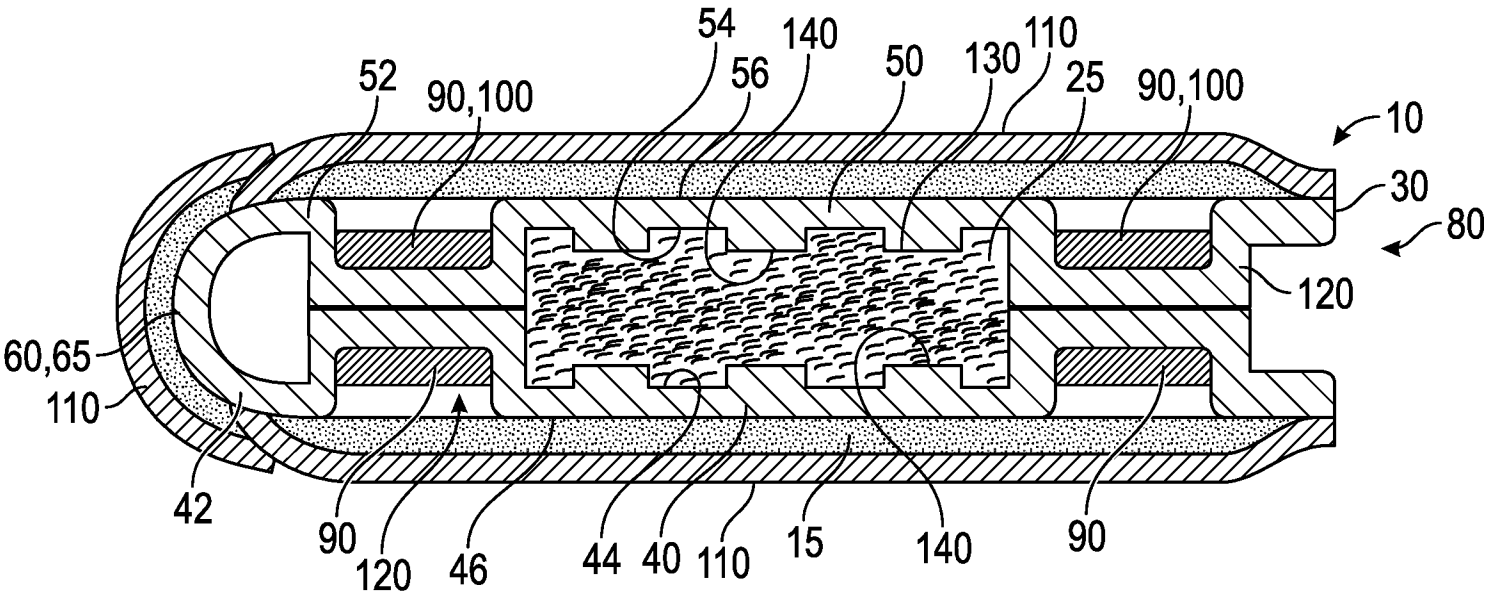
FIG. 5 is a cross-sectional view of the invention, taken generally along line 5-5 of FIG. 2.

One or more magnets 90 are fixed with the front member 40 of the clip 30. The back member 50 of the clip 30 includes one or more corresponding magnetically-attractive elements 100, each of which are aligned with one of the magnets 90 on the front member 40 when the clip 30 is in the closed position 80. Preferably each of the magnetically-attractive elements 100 is another of the magnets 90 oriented with an opposing polarity to the magnets 90 with which they are aligned on the front member 40 when the clip 30 is in the closed position 80 (FIG. 5). Alternately the magnetically-attractive elements 100 are each a magnetically-attractive piece of metal, or one long piece of magnetically-attractive metal (not shown) that spans the entire back member 50, for example.

Preferably the front member 40 has exactly two of the magnets 90, while the back member 50 has either exactly two of the magnetically-attractive elements 100 or exactly two of the magnets 90 but polarly oppositely aligned. In some embodiments of the invention, each magnet 90 is fixed to the front member 40 in a well 120 that projects away from the inner side 44 of the front member 40 (FIG. 5). Similarly, each magnetically-attractive element 100 is fixed in another of the wells 120 that projects away from the inner side 54 of the back member 50 (FIG. 5). Each protruding well 120 makes substantial mutual contact when the clip 30 is in the closed position 80. The magnets 90 each attract the magnetically-attractive elements 100 through the front and back members 40,50, and a space 130 is defined between the inner sides 44,54 of the front and back members 40,50 for capturing the person's hair 25 therebetween. The wells 120 are each open at either the outer side 46,56 (FIGS. 1 and 5) or the inner side 44,54 (FIG. 4), thereby allowing insertion of the magnet 90 or the magnetically-attractive element 100 into the well 120. The space 130 may further include raised grips 140 (FIGS. 1 and 5) projecting away from the inner side 44,54 of each member 40,50 for pressing against and further retaining the person's hair 25.

The hair extensions 15 are fixed with at least the outer side 46 of the front member 40, and preferably also with the outer side 56 of the back member 50 and the hinge 60. Preferably the hair extensions 15 are fixed with the clip 30 at the outer sides 46,56 of the members 40,50 with adhesive tape 110, preferably being a medical grade adhesive tape and, in some embodiments, transparent tape. Alternately the hair extensions 15 may be fixed with the clip 30 with adhesive, ultrasonic bonding, a mechanical clasp, a mechanical snap, or the like.

Figure 4:
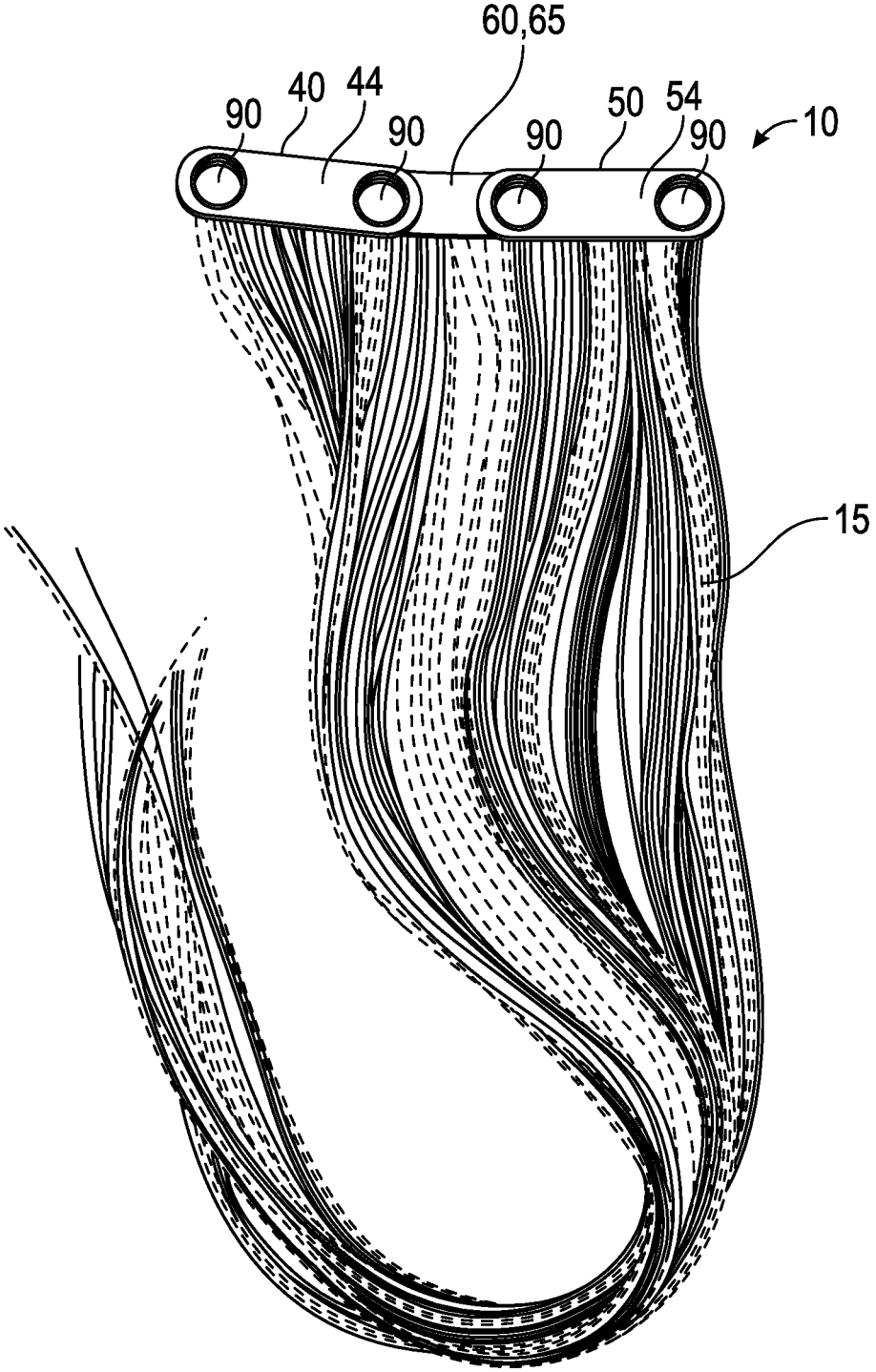
FIG. 4 is a front elevational view of the invention, illustrated in an open position.

In use with the clip 30 closed about the person's hair 25, the hair extensions 15 hang downwardly (FIG. 3) to augment the appearance of the person 20. The person's hair 25 not within the clip 30 can be combed over the clip 30 to hide the clip 30 from casual view (FIG. 4).

Figure 6:
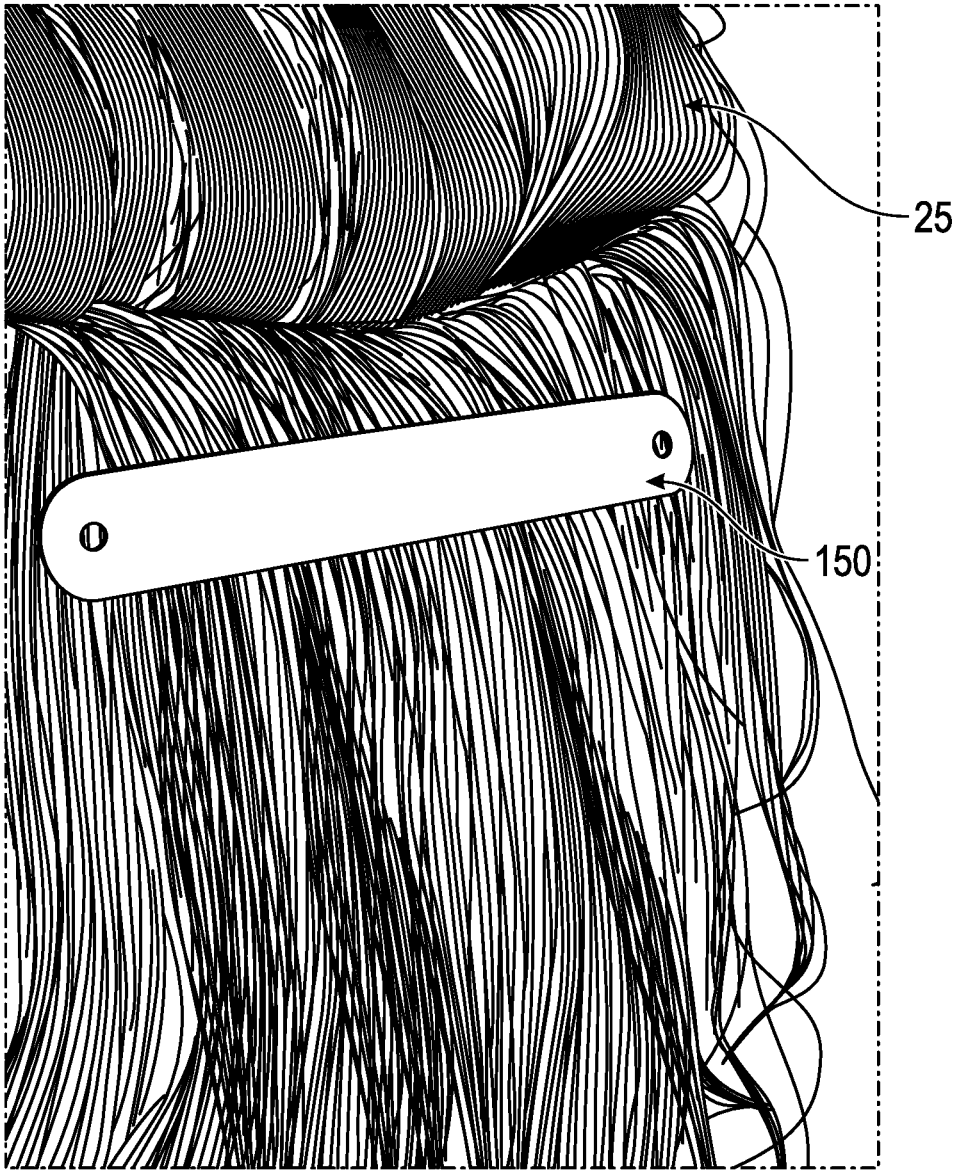
FIG. 6 is a perspective view of a magnetically attractive strip applied to the person's hair in an alternate embodiment of the invention.
Figure 7:
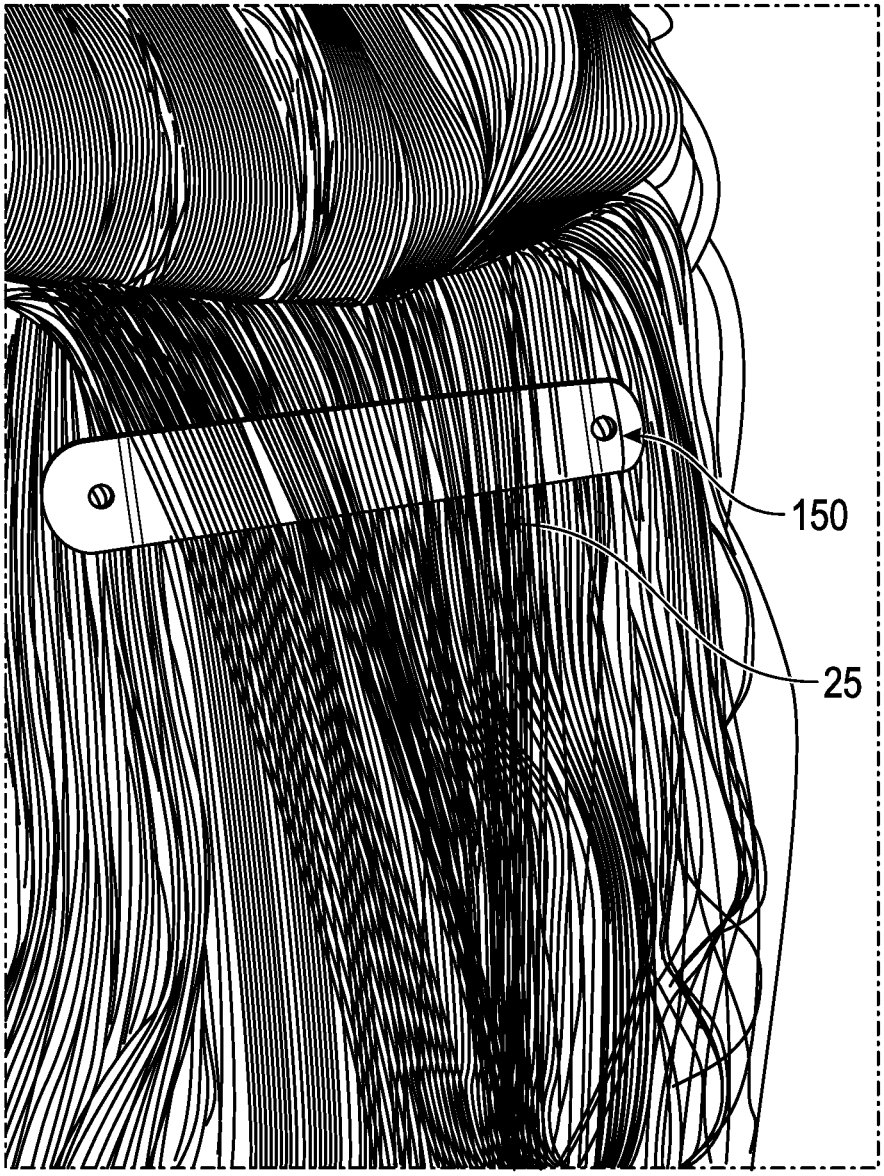
FIG. 7 is a perspective view of the magnetically attractive strip with a portion of the person's hair placed thereover.
Figure 8:
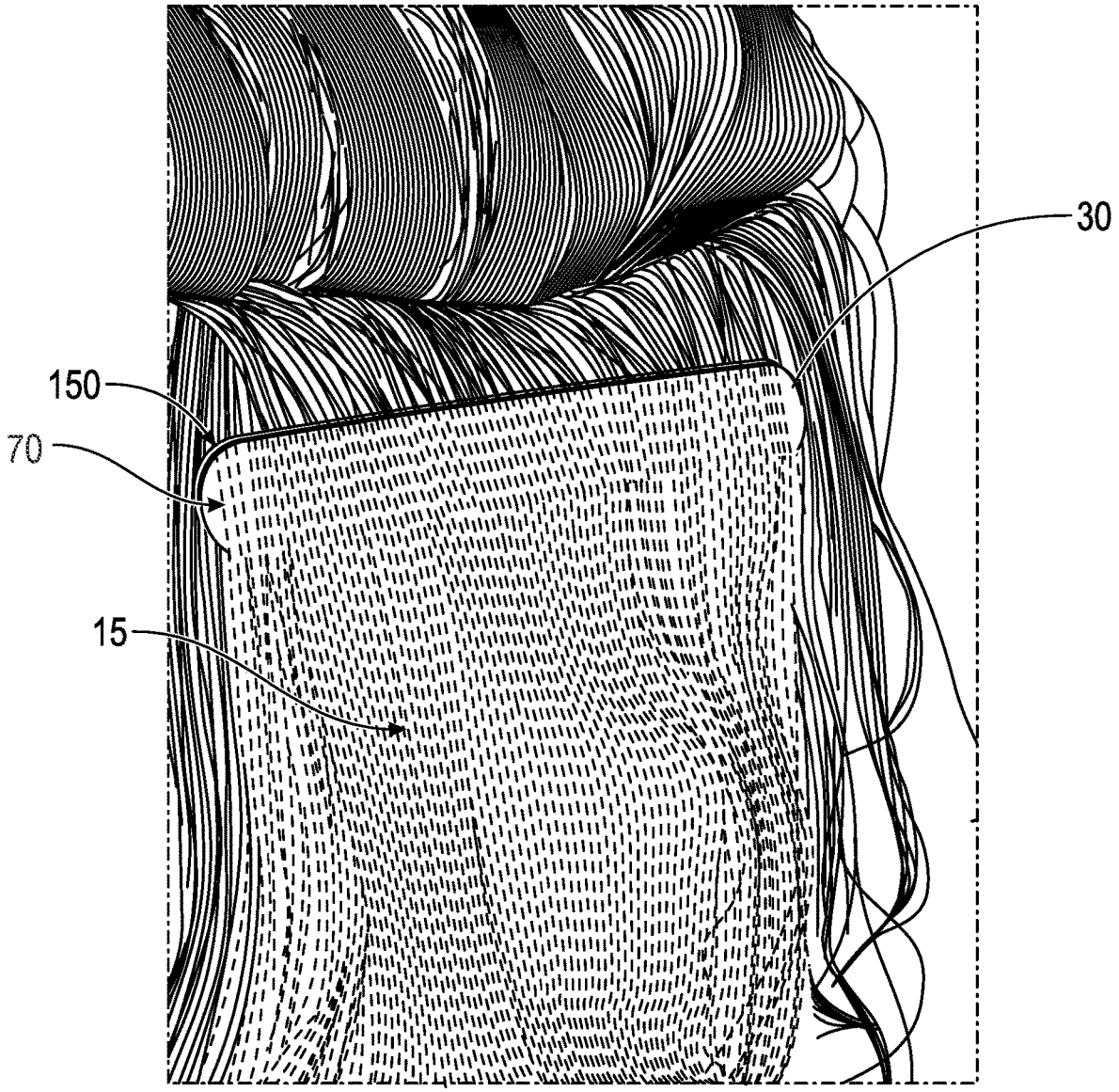
FIG. 8 is a perspective view of the magnetically attractive strip and portion of the person's hair covered with the clip in the open position, the clip being magnetically attracted to the magnetically attractive strip.

In some embodiments, illustrated in FIGS. 6-8, a magnetically attractive strip 150 for receiving the clip 30 when in the open position 70 thereon magnetically. With the magnetically attractive strip 150 is positioned on the person's head with some of the person's hair 25 positioned over the magnetically attractive strip 150, the inner sides 44,54 of each member 40,50 of the clip 30 is placed onto the magnetically attractive strip 150 to augment the appearance of the person 20. In some embodiments the magnetically attractive strip 150 includes a fastening material (not shown), such as a hook-side of a hook-and-loop type fastening material, on a distal side for temporary attachment to the person's hair 25.

While a particular form of the invention has been illustrated and described, it will be apparent that various modifications can be made without departing from the spirit and scope of the invention. For example, elongated front and back members 40,50 are illustrated in the figures, but the shape of such front and back members 40,50 could be circular, square, hexagon, or any other suitable shape. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A hair accessory for attaching hair extensions to a person's hair, comprising:

a clip having a front member and a back member, each member having a proximal end mutually pivotally connected with a hinge, each member having an inner side and an outer side, the clip positionable between an open position wherein each member is mutually separated, and a closed position wherein the inner sides of the members are substantially in mutual contact and alignment;

one or more magnets fixed with the front member of the clip, the back member of the clip including one or more magnetically-attractive elements each aligned with one of the magnets on the front member when the clip is in the closed position, each magnet fixed with the front member in a well that projects away from the inner side of the front member, each magnetically-attractive element fixed with the back member in a well that projects away from the inner side of the back member, each projecting well making substantial mutual contact when the clip is in the closed position, the magnets each attracting the magnetically-attractive elements through the front and back members, a space defined between the inner sides of the front and back members for capturing the person's hair therebetween;

the hair extensions fixed with at least the outer side of the front member;

whereby with the clip closed about the person's hair, the hair extensions hang downwardly to augment the appearance of the person.

2. The hair accessory of claim 1 wherein the hinge is a living hinge and the front member, hinge, and back member are all integrally formed from a non-rigid material.

3. The hair accessory of claim 2 wherein the non-rigid material is an elastomeric material.

4. The hair accessory of claim 2 wherein the non-rigid material is a silicone rubber material.

5. The hair accessory of claim 1 wherein the magnetically-attractive elements are each magnets positioned with an opposing polarity to the magnets with which they are aligned on the front member when the clip is in the closed position.

6. The hair accessory of claim 1 wherein each member has two of the magnets and two of the magnetically-attractive elements.

7. The hair accessory of claim 6 wherein each magnet is fixed with the front member at the outer side thereof in the well that projects away from the inner side of the front member, and wherein each magnetically-attractive element is fixed with the back member at the outer side thereof in the well that projects away from the inner side of the back member.

8. The hair accessory of claim 7 wherein a portion of the inner side of each member between the wells includes a plurality of raised grips for pressing against and further retaining the person's hair.

9. The hair accessory of claim 1 wherein the hair extensions are fixed with both the outer side of the front member and the outer side of the back member.

10. The hair accessory of claim 1 wherein the hair extensions are fixed with the outer side of the front member with an adhesive tape.

11. The hair accessory of claim 10 wherein the adhesive tape is substantially transparent.

12. The hair accessory of claim 1 wherein the hair extensions are fixed with both the outer side of the front member and the outer side of the back member with an adhesive tape.

13. The hair accessory of claim 12 wherein the adhesive tape is substantially transparent.

14. The hair accessory of claim 1 wherein a portion of the inner side of each member includes a plurality of raised grips for pressing against and further retaining the person's hair.

15. The hair accessory of claim 1 wherein each well is open at the outer side of the member.

16. The hair accessory of claim 1 wherein each well is open at the inner side of the member.

17. A hair accessory for attaching hair extensions to a person's hair, comprising:

a clip having a front member and a back member, each member having a proximal end mutually pivotally connected with a living hinge, each member having an inner side and an outer side, the clip made with a non-rigid material and positionable between an open position wherein each member is mutually separated, and a closed position wherein the inner sides of the members are substantially in mutual contact;

two magnets each fixed in one of two wells that project away from the inner side of the front member and that are open at the inner side or the outer side of the front member, and two opposing magnets each fixed in one of two wells that project away from the inner side of the back member and that are open at the inner side or the outer side of the back member, each magnet on the front member aligned with and magnetically attracted to one of the magnets on the back member when the clip is in the closed position, a space defined between the inner sides of the front and back members for capturing the person's hair therebetween, the inner side of each member within the space including a plurality of raised grips for pressing against and further retaining the person's hair;

the hair extensions fixed with both the outer side of the front member and the outer side of the back member;

whereby with the clip closed about the person's hair, the hair extensions hang downwardly to augment the appearance of the person.

18. A hair accessory for attaching hair extensions to a person's hair, comprising:

a clip having a front member and a back member, each member having a proximal end mutually pivotally connected with a hinge, each member having an inner side and an outer side, the clip positionable between an open position wherein each member is mutually separated, and a closed position wherein the inner sides of the members are substantially in mutual contact and alignment;

one or more magnets fixed with the front member of the clip, the back member of the clip including one or more magnetically-attractive elements each aligned with one of the magnets on the front member when the clip is in the closed position, each magnet fixed with the front member in a well that projects away from the inner side of the front member and that is open at the inner side or the outer side of the front member, each magnetically-attractive element fixed with the back member in a well that projects away from the inner side of the back member and that is open at the inner side or the outer side of the back member, each projecting well making substantial mutual contact when the clip is in the closed position, the magnets each attracting the magnetically-attractive elements through the front and back members, a space defined between the inner sides of the front and back members for capturing the person's hair therebetween;

the hair extensions fixed with at least the outer side of the front member;

whereby with the clip closed about the person's hair, the hair extensions hang downwardly to augment the appearance of the person.

* * * * *